United States Patent [19]

Sainsbury

[11] Patent Number: 4,650,432

[45] Date of Patent: Mar. 17, 1987

[54] CONVERTIBLE RAFT, TENT AND MATTRESS

[75] Inventor: Cleo L. Sainsbury, Evergreen, Colo.

[73] Assignee: AirSamplex Corporation, Indian Hills, Colo.

[21] Appl. No.: 831,716

[22] Filed: Feb. 21, 1986

[51] Int. Cl.[4] ..... B63B 35/58

[52] U.S. Cl. ..... 441/35; 114/345; 114/352; 114/361; 441/38; 441/40; 441/125; 135/95

[58] Field of Search ..... 441/35–42, 441/88, 90, 125; 114/345, 348, 352, 353, 354, 361; 135/95, 106, 108

[56] References Cited

U.S. PATENT DOCUMENTS

| | | | |
|---|---|---|---|
| 36,685 | 10/1862 | Brecht et al. | 441/125 X |
| 1,374,994 | 4/1921 | Faik | 135/106 |
| 2,153,282 | 4/1939 | Dennis | 114/354 |
| 2,345,377 | 3/1944 | Bowen | 135/106 X |
| 2,854,014 | 9/1958 | Hasselquist | 114/349 X |

FOREIGN PATENT DOCUMENTS

| | | | |
|---|---|---|---|
| 3204420 | 8/1983 | Fed. Rep. of Germany | 441/40 |
| 8203001 | 9/1982 | World Int. Prop. O. | 135/95 |

*Primary Examiner*—Sherman D. Basinger
*Assistant Examiner*—Paul E. Salmon
*Attorney, Agent, or Firm*—Walter C. Farley

[57] ABSTRACT

A plurality of rod elements, an inflatable mattress and a cover are configured so that they can be assembled to form a stable raft having good flotation characteristics for supporting an adult individual while traversing a body of water. The components used to form the raft can be reassembled to form a tent. The components can also be disassembled and packaged into a compact, lightweight parcel for easy backpacking.

10 Claims, 12 Drawing Figures

CONVERTIBLE RAFT, TENT AND MATTRESS

This invention relates to a structure for a raft having components which can be reassembled to form a tent and a sleeping mattress and which can be disassembled and gathered together in a lightweight, compact package for backpacking.

BACKGROUND OF THE INVENTION

Those who spend time living out-of-doors, whether for pleasure or as part of a gainful occupation, and particularly those who traverse sparsely inhabited regions, have long recognized the value of having shelter available at night or in inclement weather. Thus, many forms of tents have been devised in varying degrees of complexity. Many tents available today make effective use of modern materials, including plastics, light-weight and water-repellent fabrics, which may also be all or part plastic, and light-weight metals.

The camper or outdoor traveler who is traversing back country on foot often becomes aware of another need, that for a watercraft of some type to help him or her cross a lake or stream which blocks the desired path. Most often, it is necessary to walk a considerable distance to find a way around a lake or to find a place where a stream can be crossed without swimming. Since someone living in remote areas usually relies on fish as a significant part of his or her diet, it is also important to have a fishing craft available. While inflatable mattresses are commonly available, and can double as a raft in emergency circumstances, they are recognized as being somewhat more useful to sleep on than as practical devices for water transportation or fishing because they are not sufficiently rigid. Those which are adequately rigid to hold an adult person above the water are so heavy and require such pressure for proper inflation that they cannot readily be orally inflated and are difficult to transport in a backpack fashion along with the other necessary equipment.

BRIEF SUMMARY OF THE INVENTION

Accordingly, an object of the present invention is to provide a watercraft having sufficient buoyancy, stiffness, and stability to serve as transportation for a person and being sufficiently light in weight to be easily transportable by that person.

A further object is to provide such a watercraft which is made using components which can be reconfigured to form a tent having a sleeping mattress therein.

Briefly described, the invention includes a raft having components adapted for reconfiguration to form a tent comprising an orally inflatable, generally rectangular mattress of waterproof material having a total volume sufficient to buoyantly support a person in water and a cover dimensioned to completely surround the mattress and overlap on one side of the mattress. Fastener means is provided on the cover for holding the cover in a mattress-surrounding and overlapping position. The cover also has a plurality of elongated, parallel pockets arranged so that they extend along a face of the mattress, parallel with the longest dimension of the mattress when it is surrounding the mattress. A plurality of elongated rods are dimensioned to be insertable into the pockets as stiffening supports for holding a passenger on the mattress in a body of water. At least two of the rods are dimensioned to extend beyond opposite ends of the mattress when in the pockets, opposite ends of the rods being attachable to first and second transverse support members to form a rectangular frame. At least two of the rods have means at the ends thereof to permit assembly as a tent ridgepole and others have means for connection to the ridgepole to serve as vertical supports for the ridgepole. The cover has reinforced openings along the edge to receive tie-down lines so that the cover can be removed from around the mattress, placed over the assembled ridgepole and tied to tent stakes in the ground to form a shelter.

In order to impart full understanding of the manner in which these and other objectives are attained in accordance with the invention, particularly advantageous embodiments thereof will be described with reference to the accompanying drawings, which form a part of this specification, and wherein.

Figure 1:
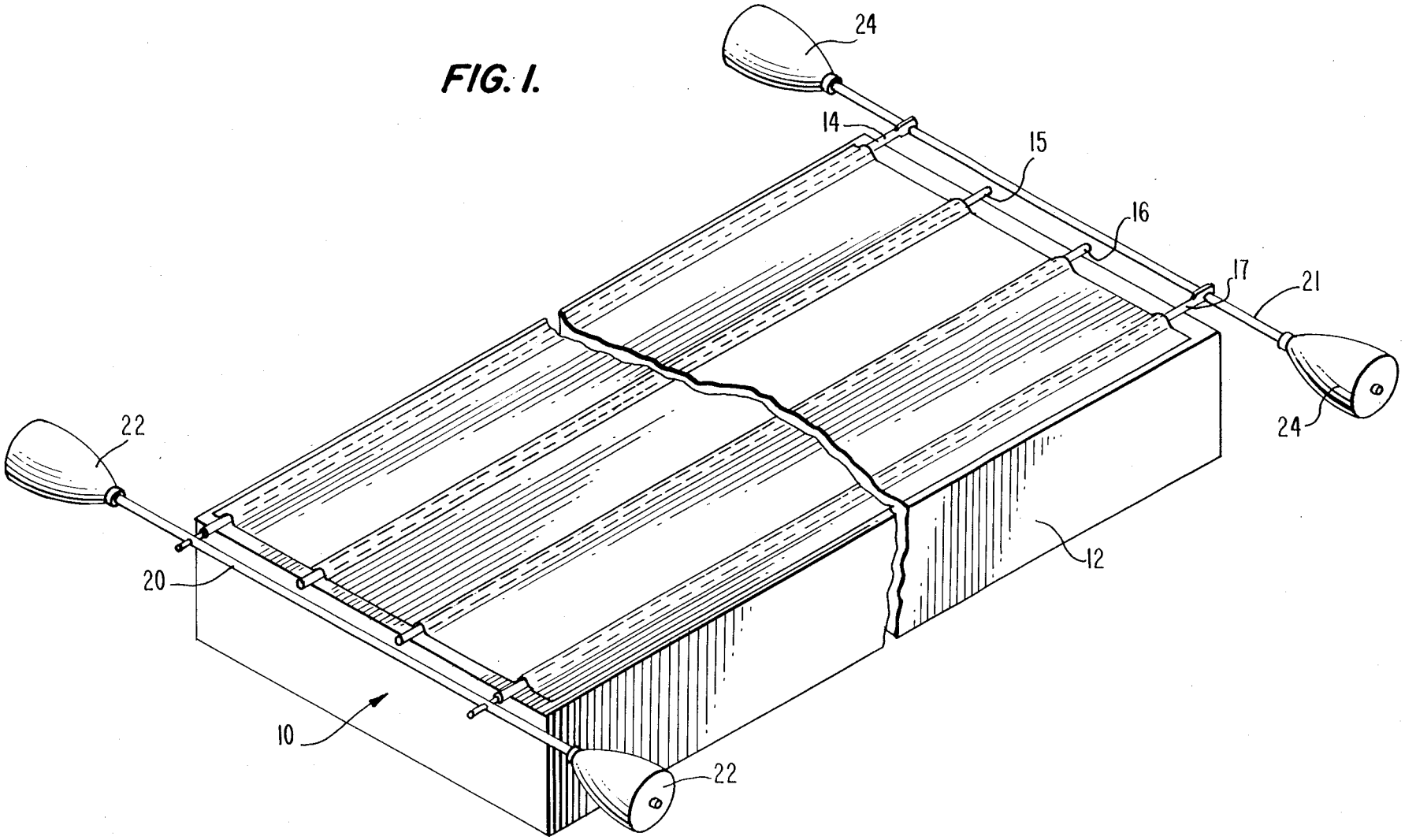
FIG. 1 is a perspective view of a raft in accordance with the invention.
Figure 2:
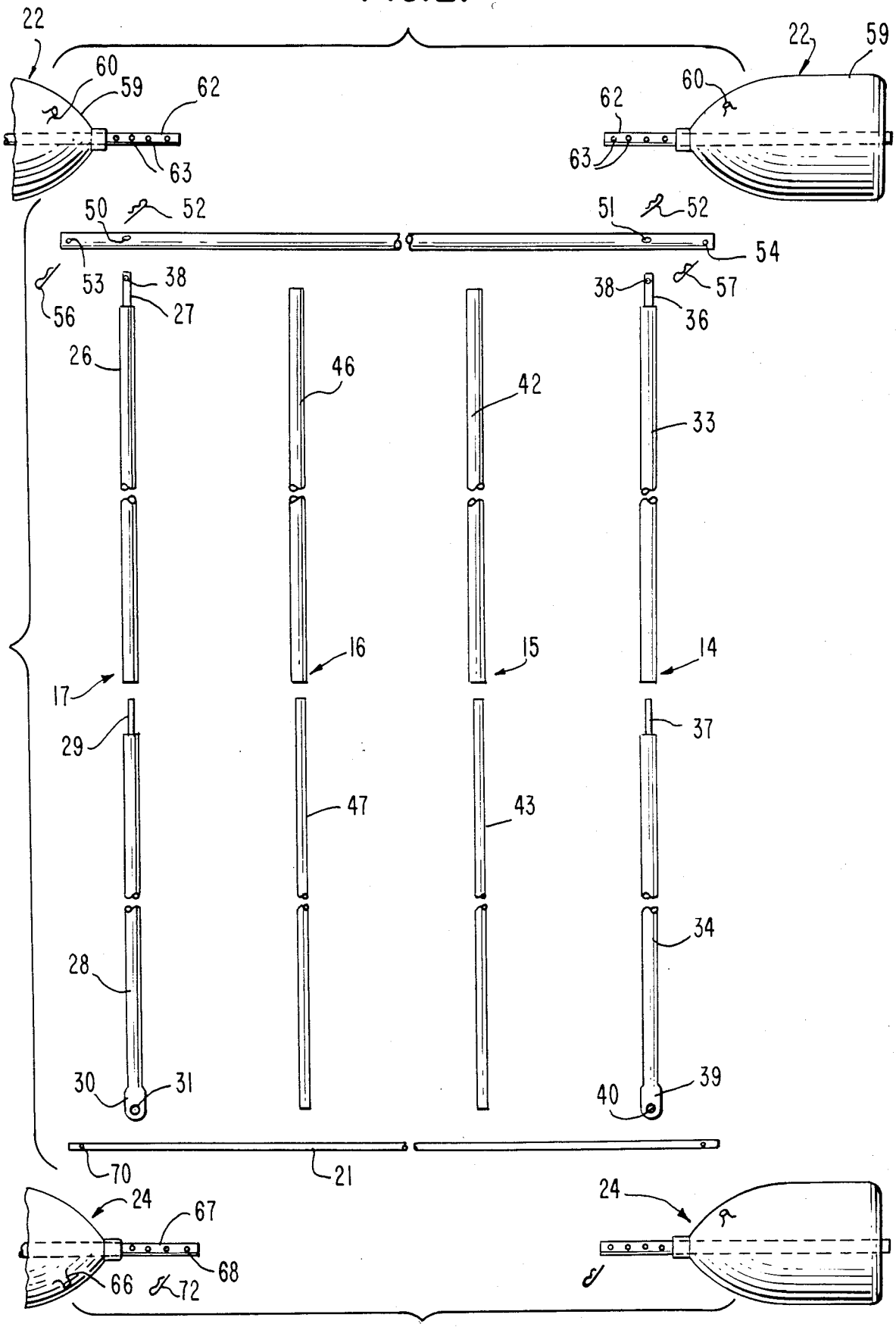
FIG. 2 is an exploded, partially foreshortened, view of the framework components in their relative positions to be assembled into the raft of FIG. 1.
Figure 4:
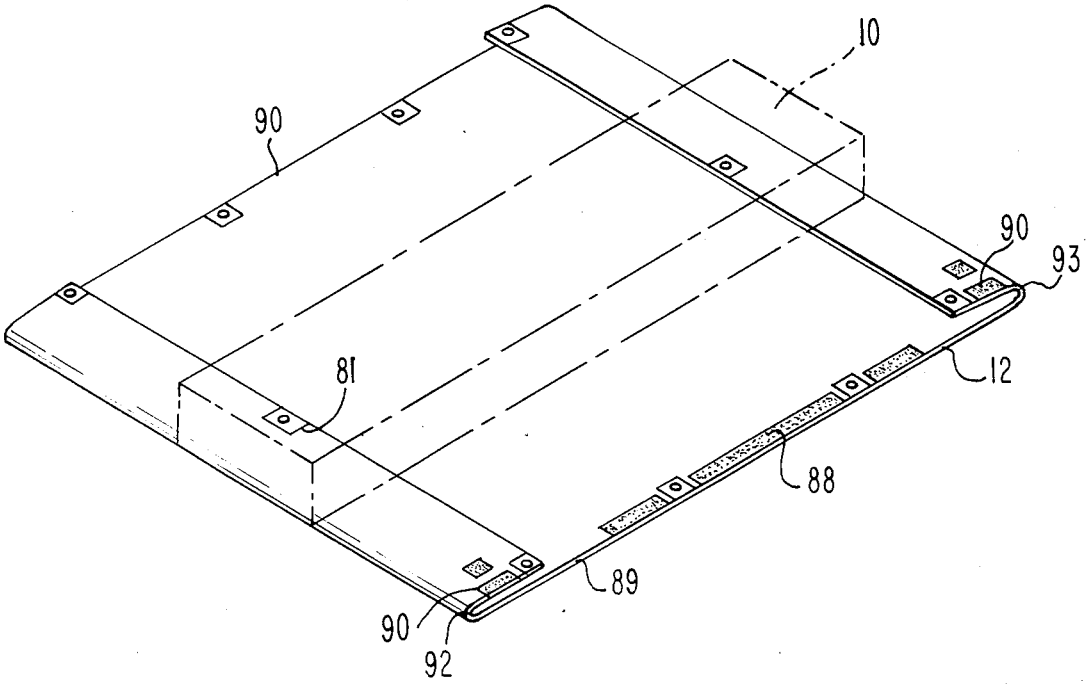
Figure 5:
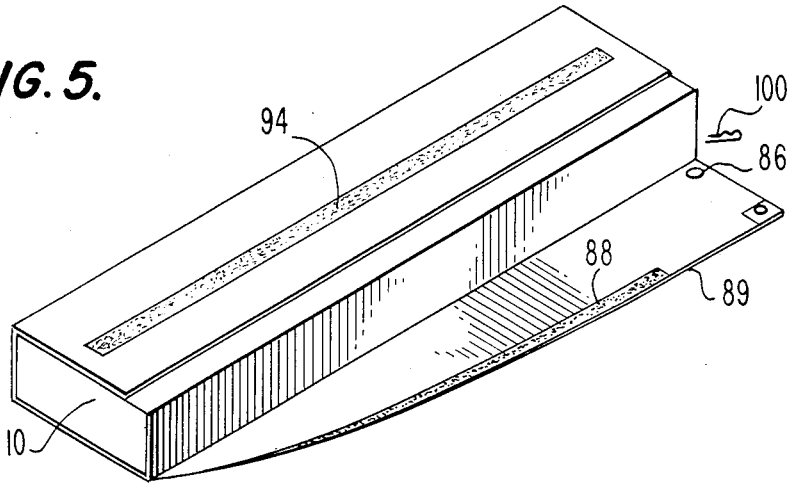
Figure 6:
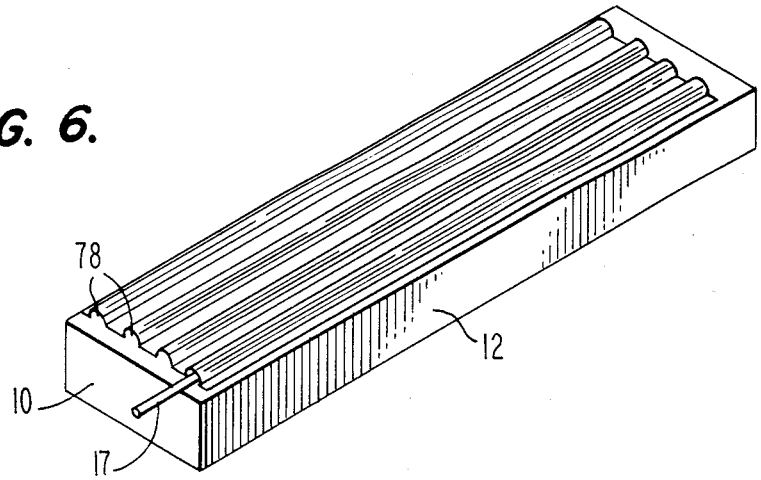
Figure 7:
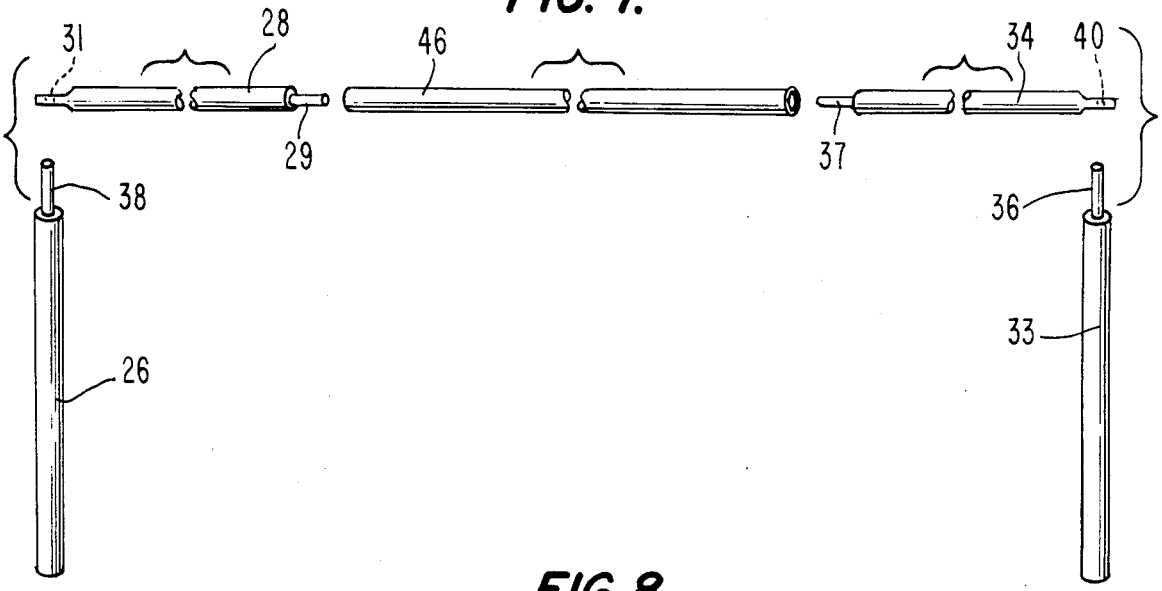
Figure 8:
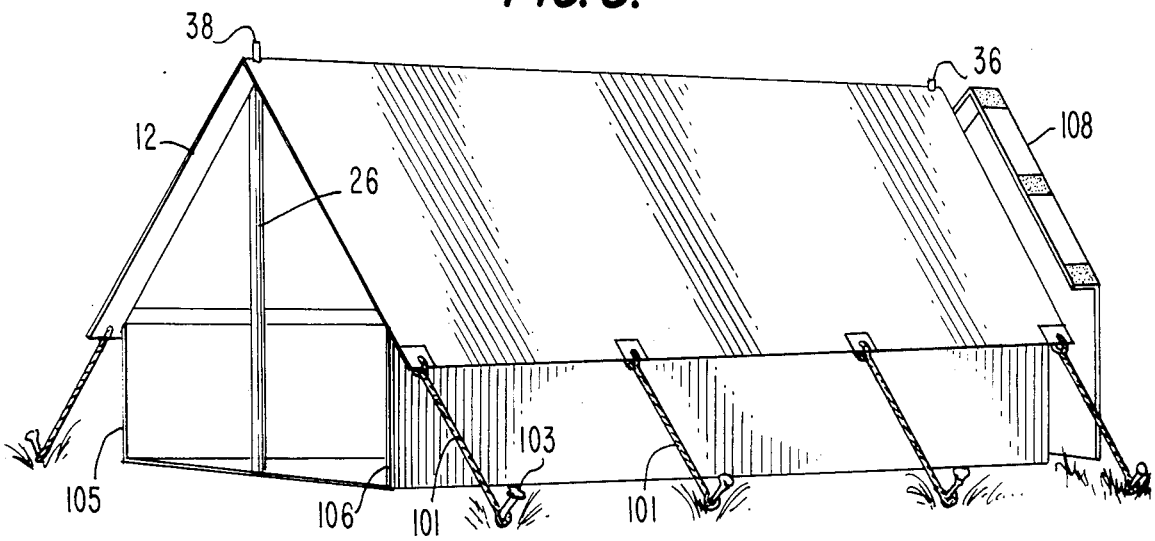
Figure 9:
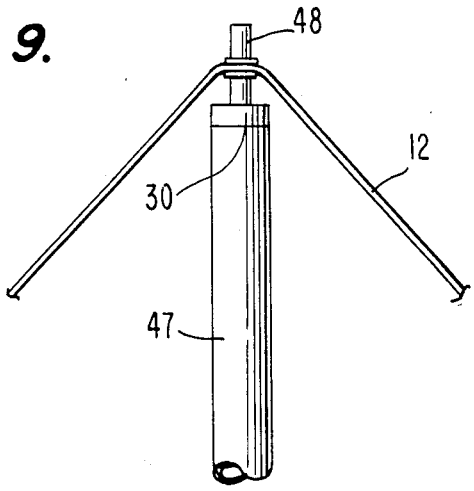
Figure 10:
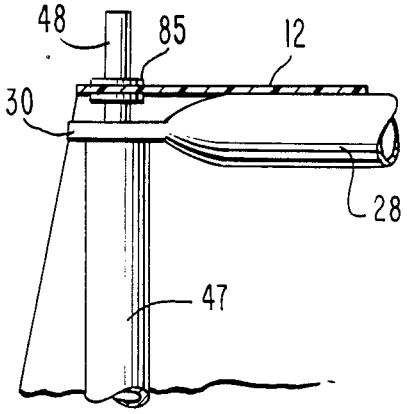
Figure 11:
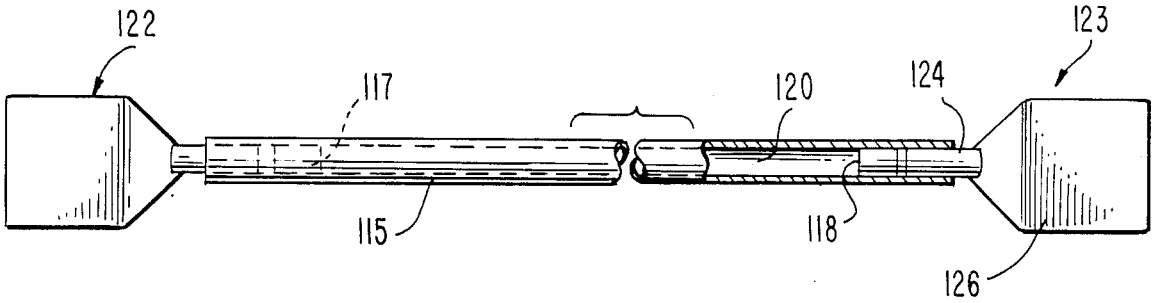
Figure 12:
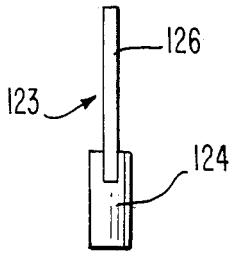

FIGS. 4, 5, and 6 are simplified perspective views showing steps in the assembly of components to form a raft such as shown in FIG. 1;

FIG. 7 is an exploded, partially foreshortened view of components selected from the components in FIG. 2 assembled to form a tent ridgepole and support;

FIG. 8 is a perspective view of a tent formed from the raft components;

FIG. 9 is a partial end elevation of the ridgepole, upright and tent cover assembly of the tent of FIG. 8;

FIG. 10 is a side elevation, in partial section, of the structure of FIG. 9;

FIG. 11 shows a paddle structure usable with the raft of the present invention; and FIG. 12 is a detailed view of a portion of the paddle structure of FIG. 13.

DETAILED DESCRIPTION OF PREFERRED EMBODIMENTS

FIG. 1 shows a perspective view of a raft assembly, the components of which can be rearranged to form the tent of FIG. 8. As shown in FIG. 1, the basic components of the raft are a generally rectangular, inflatable mattress indicated generally at 10, a cover 12 which surrounds the mattress and overlaps at one side thereof, as will be described, and a framework which lends rigidity to the structure. The framework includes a plurality of elongated rod assemblies 14, 15, 16 and 17, which are dimensioned to be received in pockets in cover 12. The framework also includes transverse support members 20 and 21 which are also advantageously assemblies of shorter members. At the ends of support members 20 and 21 are floats 22 attached to the ends of member 20 and floats 24 which are attached to the ends of member 21.

The details of the support members forming the framework are more clearly seen in FIG. 2, although it will be recognized that a variety of modifications can be made therein. In particular, it will be noticed that FIG. 2 illustrates various components as being uniformly dimensioned. While this is certainly advantageous insofar as production is concerned, and although it has certain other advantages, this is not an essential aspect of the invention as will be recognized from the following discussion.

The rod assembly indicated generally at 17 includes a rod 26 which has a reduced diameter portion 27 at one end thereof and a hollow socket at the other end; and a rod 28 which has a reduced diameter portion 29 at one end and a flattened portion 30 at the other end, the flattened portion having a central opening 31 which is dimensioned to receive rod 21. Reduced diameter portion 29 is dimensioned to be received in the socket in the end of rod 26, this connection preferably being a rather snug fit so that the rods will remain assembled under normal circumstances but can be removed by an individual without the use of tools. If desired, a threaded connection can be employed, but this is generally not necessary and increases the production cost.

These components can be produced from tubular anodized aluminum stock, the portions 27 and 29 of reduced diameter being made by either compressing the end of the tube into a smaller circular portion or by inserting and securing a separate piece of rod. The flattened end can be produced by simply pressing or hammering and shaping the end of the rod and then drilling a hole therethrough. The total length of the rod assembly is preferably about 6.5'.

Rod assembly 14 includes rods 33 and 34 which are substantially identical to rods 26 and 28, respectively, having reduced diameter end portions 36 and 37. Rod 34 has a flattened end portion 39 with a hole 40 to receive rod 21. As with assembly 17, reduced diameter portion 37 fits in the end of rod 33.

Assemblies 15 and 16 are also substantially identical to each other. Assembly 15 includes a tube 42 and a tube 43 which has a diameter selected so that tube 43 slips snugly into tube 42. Assembly 16 includes a tube 46 and a tube 47 which can be slipped snugly into tube 46. As illustrated in FIGS. 1 and 2, rod assemblies 15 and 16 are somewhat shorter than rod assemblies 14 and 17 but the total lengths thereof can be altered by simply sliding more of one tube into the other. Thus, assemblies 15 and 16 preferably extend for substantially the full length of mattress 10 but do not intersect or engage transverse support members 20 and 21.

Support member 20 comprises a hollow rod or tube about 30" in length having holes 50 and 51 a few inches from the ends thereof to receive reduced diameter portions 27 and 36, respectively. Closer to the ends of rod 20 are holes 53 and 54, drilled along lines perpendicular to holes 50 and 51, to receive retaining pins 56 and 57 to hold the float assemblies 22.

Each float assembly 22 includes an inflatable elongated polyethylene bag 59 having a valve 60 through which the bag can be orally inflated. Each bag is inserted over and adhered at at least one end to a relatively short rod 62 which has a plurality of holes 63 passing therethrough and spaced about 2" apart. Each rod 62 extends the full length of the bag and engages both ends thereof to prevent the bag from "bending" upwardly when it is immersed in water. The bag can be toroidal or can be adhered at both ends. The rod 62 is insertable into one end of tube 20 until one of holes 63 is aligned with hole 53, whereupon a pin 56 can be inserted through the aligned openings to keep the float assembly in place. Several holes 63 are provided to permit variation in the stabilization effect of the float. As will be recognized, a rigid container could be used for float 22. In fact, substantially rigid plastic soft drink bottles having a volume of about 2 liters each were used for floats in a field-tested experimental model. However, a deflatable and inflatable float having about a 2 liter inflated volume is greatly preferred for packing and transportation reasons, although the volume can be varied.

At the other end, float assemblies 24 are basically similar except that the inflatable bags 65 having valves 66 are slipped over and connected to relatively short tubes 67 having holes 68 which are alignable with holes 70 through the ends of rod 21. Retaining pins 72 can then be inserted through the aligned holes to keep the float assemblies in place.

Figure 3:
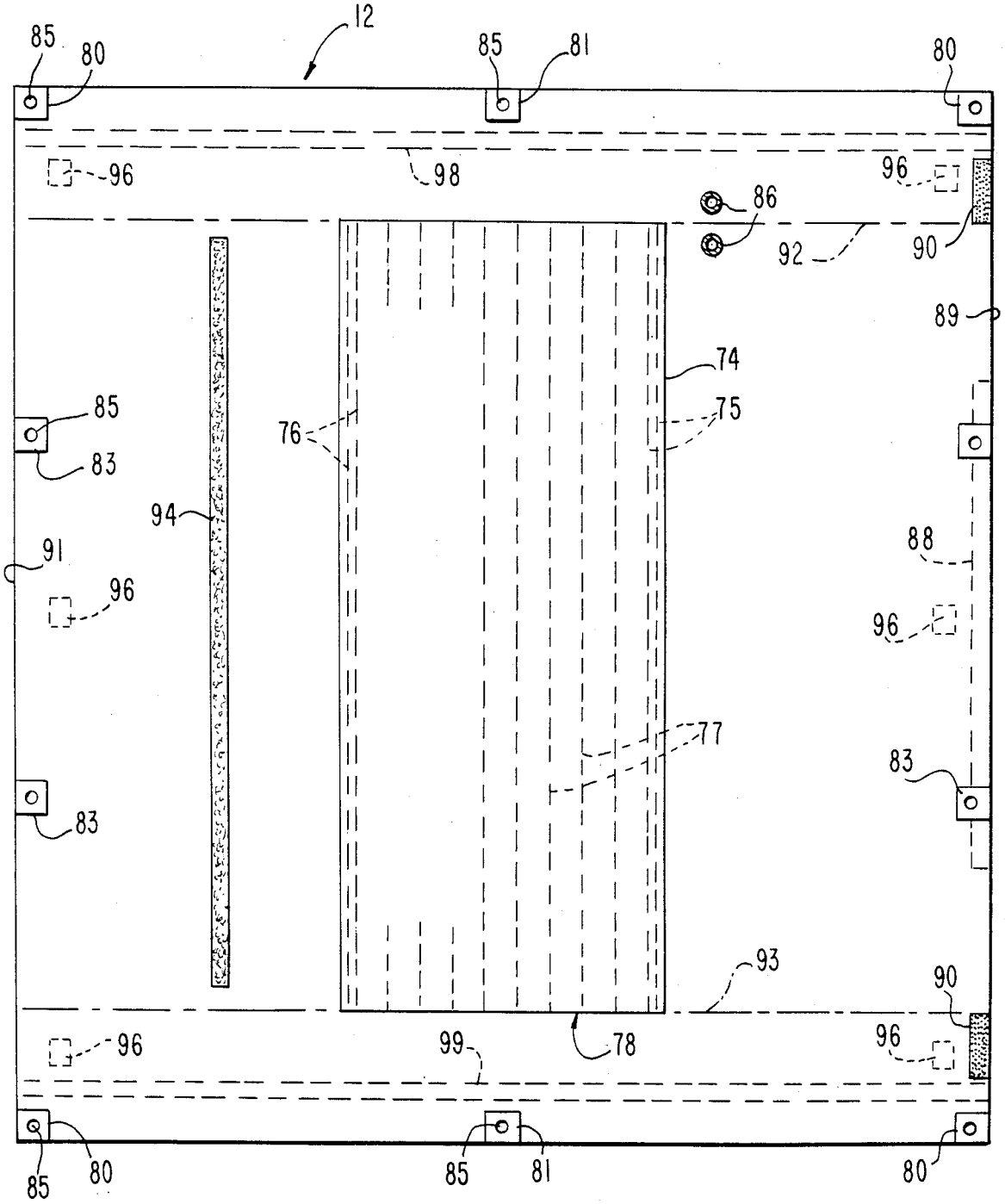
FIG. 3 is a plan view of a raft cover and tent cover in its unfolded, open position.

The final major components of the assembly is shown in FIG. 3 and comprises a cover which will function not only as a cover for the mattress and a retainer for the framework assembly of FIG. 2 when the structure is assembled as a raft, but will also serve as the tent cover. The cover, indicated generally at 12, is preferably made from a piece of treated rip-stop nylon having a length of about 8 feet and a width of about 7.5 feet. A separate panel 74 is sewed to the center of the cover, panel 74 having a longitudinal dimension of about 6 feet and a width of about 3.0 feet, the 6 foot dimension being parallel with the 8 foot dimension of cover 12. Panel 74 is stitched to the cover along its edges, as indicated by the dashed lines at 75 and 76, and is also attached to the cover along a plurality of parallel stitch lines 77 to form a plurality of elongated, tubular pockets 78 between cover 12 and panel 74. As will be apparent from the illustration, a relatively large number of pockets is formed, but not all of them need be used. In the embodiment shown in FIG. 3, nine pockets are created, each having a width of about 1.5" to 2" for receiving the rod assemblies. The outer dimensions of the panel 74 are approximately the same as the dimensions of raft 10. Thus, when the cover is placed on the raft, rod assemblies 14 and 17 can be placed in the outer two pockets and rod assemblies 15 and 16, by themselves or in conjunction with additional rod assemblies, can be placed in selected ones of the inner pockets, the separation of the inner rods being less critical because they need not match with openings or other characteristics of the end support members. Preferably, one of the pockets is substantially aligned with the center of the cover for receiving a tent ridgepole as will be described.

Several other important features and characteristics of cover 12 must now be described. In forming the cover, the edges should be folded and stitched with relatively small squares of reinforcing cloth 80 attached to, or stitched into, the corners of the cover. In addition, at the center of each shorter side of the cover a reinforcing patch 81 is attached. Finally, at at least two intermediate points along the longer sides of the cover additional patches 83 are attached. In each of these reinforcing patches an eyelet or grommet 85 is attached through cover fabric and the reinforcing patches. These grommets can be conventional brass grommets which are pressed through and fixedly attached into the reinforcing patches, or they can be sewn eyelets. Additional eyelets or grommets 86 are attached to two locations near one corner of panel 74 to permit the inflation valve for the mattress to extend through the cover. A strip 88 of a contact fastening material of the hook and loop type, commonly known by the trademark VELCRO, is attached along a portion of one edge 89 of the cover. This strip 88 can be interrupted so as to not interfere with grommets 85. The view in FIG. 3 is regarded as being from the top of the cover, that is, the surface of the cover to which panel 74 is attached. Thus, strip 88 is on the underside of the cover as seen in this figure. Additional strips of the same kind of material 90 are attached to the upper surfaces of the cover near the ends.

The positioning of strips 88 and 90 is determined by the location of the opposite narrow ends of panel 74, extensions of which are identified in FIG. 3 by dot-dash lines 92 and 93 which constitute fold lines for the cover. When the cover is used in the raft configuration, the end portions of the cover will be folded under the center portion along those fold lines, whereupon strips 90 will be aligned with, and on the same side of the cover as, strip 88. Another strip of hook and loop fastening material 94 is attached to the upper surface of cover 12, strip 94 being of the opposite type from strips 88 and 90, so as to be connectable therewith. The exact position of strip 94 is determined by the specific dimensions of the mattress with which the cover is used. It extends parallel with the long sides of panel 74 and lies between the panel and the edge opposite edge 89 and is located so that when the cover wraps around the mattress strip 94 engages strips 88 and 90 so as to hold the cover in a rather firm, encircling engagement with mattress 90.

Additional VELCRO patches 96 are attached to the undersurface of cover 12 for use when the cover is employed as a tent. Finally, elongated strips 98 and 99 of hook and loop fastener material extend across the ends of the underside of the cover, also for use when the cover is employed as a tent.

The manner in which these components are assembled to form a raft can be seen by the progressive illustrations in FIGS. 4, 5, and 6. As seen in FIG. 4, cover 12 is placed on the ground upside down, i.e., with panel 74 lying on the ground and with VELCRO strip 88 facing upwardly. The ends of the cover are then folded over along lines 92 and 93 to form a cover arrangement which is approximately 6 feet long, about the same length as the inflatable mattress, and of sufficient width to be wrapped around the mattress with some overlap. The mattress 10, shown in FIG. 4 in dot-dash lines, is then placed upon the cover, overlaying the location of panel 74 which is easily identified from the underside because of the locations of stitches 75 and 76.

As seen in FIG. 5, the side of the cover having edge 90 is then folded over the mattress so that hook and loop fastener strip 94 lies atop the mattress. The side of the cover having edge 89 is then folded up over the other side of the mattress so that edge 91 is covered thereby and so that fastener strip 88 engages fastener strip 94. In this last step, the valve 100, which is preferably near a corner of mattress 10, is inserted through aligned eyelets 86. This can be an important feature because the valve is then exposed with the cover on the mattress, permitting oral inflation or reinflation of the mattress in the event of a small leak.

With strips 88 and 90 firmly engaged with strip 94, the mattress and cover assembly can then be inverted so that panel 74 with its pockets 78 is exposed as shown in FIG. 6 so that rod assemblies 14–17 can be put together and inserted into the pockets. After insertion of the rod assemblies, transverse support 21 can be inserted through holes 31 and 39 and the float assemblies 24 can be attached to its ends. Rod 20 can be slipped over reduced diameter end portions 27 and 36 so that retainer pins 52 can be inserted through holes 38 to keep the assembly together. Holes 50 and 51 are preferably spaced apart such that when rod assemblies 14 and 17 are coupled to rod 20 the cover portion between the rod assemblies is reasonably taut. Float assemblies 22 can be attached to rod 20 either before or after its connection to rod assemblies 14 and 17.

The resulting assembly is that shown in FIG. 1. Using an inflatable mattress which has a rather rectangular outer configuration to improve stability, and preferably having dimensions of about 6 feet by 3.0 feet by 0.5 feet, the assembly has a net buoyancy in excess of 500 lbs., which means that a 200 lb. person can be on the raft with less than one-half of the raft immersed in the water. With floats 22 and 24 extended, this provides an additional buoyancy of about 140 lbs. (enough for emergency flotation should the mattress be seriously punctured) and a further stabilizing influence, somewhat in the manner of outriggers, the floats having a greater influence than conventional outriggers and exercising a stabilizing force somewhat beyond the buoyancy which would be provided by additional mattress chambers of the same interior volume. The assembly can be used in the position shown in FIG. 1 or inverted. While the above dimensions are not critical, the total volume of the mattress should be at least sufficient to provide adequate buoyancy to keep the rider afloat.

As will be recognized from the above discussion, none of the components are longer than approximately 3.5 feet which means that all of the rod members can be bundled together and wrapped within the folded cover 12 to form a compact package which is easily transported, the total assembly, as constructed in prototype form, having a weight of about 8 to 9 lbs. which may vary according to the weigh of the rods used.

In order to form a tent, the same components are reassembled as shown in FIGS. 7 and 8. First, a tent ridgepole is formed using tube 46 or tube 42 along with rods 28 and 34, tubes 46 and 42 being of large enough inner diameter to slip over rods 28 and 34. Reduced end portions 29 and 37 are inserted into the opposite ends of tube 46, forming a ridgepole. Rod 26 is then employed as one end member for the ridgepole, the larger end of rod 26 being inserted into the ground with the reduced diameter portion 38 pointing upwardly. Hole 31 is then placed over portion 38, supporting one end of the ridgepole. Rod 33 is then placed with its reduced diameter portion 36 pointing upwardly and inserted through hole 40. Rod 33 can then be pushed or pounded into the ground, forming the other end support for the ridgepole.

Cover 12 is then placed on the ridgepole either by lifting one end of the assembled ridgepole and inserting it into the central one of pockets 78, or by simply placing the cover over the ridgepole with one of the grommets 85 placed over reduced diameter portion 38 to fixedly locate one end of the tent. If the ridgepole components are arranged so as to total a length of 8 feet, the other grommet 85 can be placed over the other reduced diameter portion. The length an be adjusted by sliding the tubes in or out.

Additional components which are needed to complete the basic tent are tie lines 101 and stakes 103. Since these are conventional they will not be further described. The tie lines, as illustrated in FIG. 8, are passed through grommets 85 along edges 89 and 91 of cover 12 and are connected to stakes which are securely fastened at suitable locations in the ground. If wind conditions are severe, additional ones of the stiffening rods can be inserted in the pockets of the cover to prevent the cover from whipping and snapping the tent and keeping the occupant awake. This completes the basic construction of the tent. The inflated mattress can be placed within the tent forming a comfortable shelter for sleeping.

A further accessory device which can be used with this assembly includes mosquito netting which can be placed over the ridgepole before cover 12 is draped over it, forming an inner shelter which is particularly usable in areas where insects are a significant problem. A floor for the tent can also be provided in the form of a separate piece of fabric which can be used to cover and protect the user's sleeping bag, etc., at a campsite while the other components are being used as a fishing raft. Additional side panels 105 and 106 can be supplied with the other components for attachment to VELCRO patches 96 so that they depend from the side portions of cover 12 to the ground. End panels 108 can also be supplied for connection to strips 98 and 99 to form a completely enclosed tent, particularly for use in regions of severe or very wet weather. Alternately, mosquito netting can be attached to VELCRO strips 98 and 99 or patches 96, or both, in place of solid side panels, such considerations being determined by the intended region of use.

FIGS. 9 and 10 show, in greater detail, the desired relationship between cover 12, grommet 85 in the mid-portion of the end of cover 12, and reduced diameter portion 38 which extends through grommet 85 as well as through the hole in the flattened portion 30 at the end of rod 28. As previously indicated, if the lengths of rods 28, 34 and 46 are appropriately arranged to equal the length of cover 12 when assembled, the center-to-center distance between holes 31 and 40 is slightly less than 8 feet so that this relationship exists at both ends of the tent.

As will be recognized by those familiar with camping equipment, the stitches used to assemble the components described above, and particularly those used to attach panel 74 to cover 12, should be waterproofed to prevent leakage when the components are used as a tent.

A simple double-ended paddle which is particularly useful with the raft of the present invention is shown in FIGS. 11 and 12 and includes a hollow, anodized aluminum tube 115 having wooden plugs 117 and 118 fastened in the ends, spaced inwardly from the ends a few inches. Plugs 117 and 118 define a reasonably water-tight chamber 120 which makes the paddle buoyant so that it will float if it is dropped. Paddle plates 122 and 123 are tightly insertable into the ends of tube 115 and can be retained by pins, if necessary. Each paddle plate includes a relatively short section of rod 124 (FIG. 12) which is slotted to receive a shaped panel 126 of plywood which is glued into the slot using a waterproof adhesive. While the paddle plates can easily be made from wood, a similar structure can be formed with plastic and be molded in one piece. Rod 115 should be about 5'–6' in length but can be formed in two pieces with a threaded or other coupling, if desired, to facilitate backpacking.

While certain advantageous embodiments have been chosen to illustrate the invention, it will be understood by those skilled in the art that various changes and modifications can be made therein without departing from the scope of the invention as defined in the appended claims.

What is claimed is:

1. Apparatus forming a raft including components which can be reconfigured to form a tent comprising the combination of an inflatable, generally rectangular mattress of water repellent material having a total volume sufficient to buoyantly support a person in water;

a cover dimensioned to completely surround said mattress in one direction and to overlap on one side of said mattress;

fastener means on said cover for holding said cover in a mattress-surrounding and overlapping position;

means for forming a plurality of elongated stiffening members having lengths substantially the same as the length of said mattress;

means on said cover for receiving and holding said stiffening members adjacent the exterior of said mattress with the long axes of said stiffening members substantially parallel with the long dimension of said mattress, at least two of said stiffening members being dimensioned to extend at least to the ends of said mattress;

first and second transverse support members releasably attached to opposite ends of said at least two stiffening members to form a rectangular frame for supporting a passenger on said raft, at least two of said means forming said stiffening members having interconnectable means at the ends thereof so that said members can be coaxially assembled to form a tent ridgepole;

at least two others of said means forming said stiffening members having means at the ends thereof orthogonally connectable to said ridgepole to form vertical supports therefor between the ridgepole and the ground;

a plurality of tent ties and tent stakes; and means along the edges of said cover to receive said ties, whereby said cover can be removed from around said mattress, placed on the assembled ridgepole and secured to the ground with said ties and stakes to form a shelter.

2. Apparatus according to claim 1 wherein said means for forming a plurality of stiffening members includes at least four pairs of elongated rod members joinable end-to-end to form at least four stiffening rod assemblies.

3. Apparatus according to claim 2 wherein said means on said cover for receiving and holding said stiffening members includes a plurality of substantially parallel pockets dimensioned to receive said members, said pockets extending substantially the entire length of said mattress.

4. Apparatus according to claim 3 wherein said cover includes a first rectangular sheet of water-repellent fabric having a first dimension at least as great as the long dimension of said mattress and a second dimension greater than the girth of said mattress in a plane perpendicular to the long dimension thereof; and a second, smaller rectangular sheet of fabric attached to one side of said first sheet by a plurality of substantially parallel, spaced rows of stitches defining said pockets.

5. Apparatus according to claim 4 wherein said means to receive said ties includes grommets attached along the edges of said cover.

6. Apparatus according to claim 1 and further including first and second float members attached to opposite ends of one of said transverse support members to provide stabilizing buoyancy.

7. Apparatus according to claim 6 and further including third and fourth float members attached to opposite ends of the other of said transverse support members.

8. Apparatus according to claim 7 wherein each of said float members includes an inflatable bag.

9. Apparatus acording to claim 1 and further comprising sidewalls of ripstop nylon attached to said cover to depend from the undersurface thereof in the shelter form.

10. Apparatus according to claim 1 and further comprising sidewalls of mosquito netting attached to said cover to depend from the undersurface thereof in the shelter form.

* * * * *